United States Patent [19]

Onodera et al.

[11] 4,409,321

[45] Oct. 11, 1983

[54] METHOD FOR THE REPRODUCTION OF COLOR IMAGE

[75] Inventors: Kaoru Onodera, Odawara; Toshifumi Iijima, Kokubunji; Wataru Fujimastu, Hachioji, all of Japan

[73] Assignee: Konishiroku Photo Industry Co., Ltd., Japan

[21] Appl. No.: 341,691

[22] Filed: Jan. 22, 1982

[30] Foreign Application Priority Data

Jan. 22, 1981 [JP] Japan ..... 56-8702

[51] Int. Cl.[3] ..... G03C 7/16

[52] U.S. Cl. ..... 430/383; 430/405; 430/503; 430/505; 430/506; 430/509; 430/955

[58] Field of Search ..... 430/383, 448, 502, 503, 430/505, 566, 955, 405, 506, 509

[56] References Cited

U.S. PATENT DOCUMENTS 4,297,437 10/1981 Kancko et al. ..... 430/566

4,320,193 3/1982 Robillard ..... 430/503

*Primary Examiner*—J. Travis Brown

*Attorney, Agent, or Firm*—Finnegan, Henderson, Farabow, Garrett & Dunner

[57] ABSTRACT

A method for reproducing a color image. A dye image is formed on a photographic light-sensitive material by imagewisely exposing the material and processing to form a dye image. Through the imaged photographic light-sensitive material, an exposure is made on a photographic printing light-sensitive material which is processed in an alkaline activator solution to form a dye image thereon. The photographic light-sensitive material contains a transparent support provided thereon with red-sensitive, green-sensitive, and blue-sensitive silver halide emulsion layers. The layers each contain one of three different nondiffusible couplers capable of forming, by coupling, compounds having spectral absorption maximum wavelength in the wavelength region longer than 340 nm. The spectral absorption maximum wavelength of the compounds differ by at least 30 nm. The blue-sensitive layer contains a coupler capable of forming the compound having the highest molecular extinction coefficient among the three different couplers, whereas the green-sensitive layer contains a coupler capable of forming the compound having the lowest molecular extinction coefficient. The printing light-sensitive material contains a support provided thereon with three different light-sensitive silver halide emulsion layers respectively having spectral sensitivity corresponding to the absorption maximum wavelength of the compounds formed in the photographic light-sensitive material. The layers each comprise one of three nondiffusible yellow, magenta, and cyan couplers, and contain a color developing agent and/or the precursor thereof.

7 Claims, No Drawings

METHOD FOR THE REPRODUCTION OF COLOR IMAGE

The present invention relates to a method for the reproduction of a color image, and more particularly to a method for the reproduction of a color image capable of obtaining on a color photographic printing paper a dye image which is excellent in sharpness, graininess and the like.

In methods for the reproduction of color images, various technics have been developed for improving the sharpness and graininess of color images.

As techniques for improving the graininess, there is described in British Pat. No. 923,045 a method for improving the graininess of color images, for example, in a color photographic light-sensitive material, by adjusting the higher light-sensitive unit emulsion layer thereof so as to provide a color density fairly lower than that of the lower light-sensitive unit emulsion layer thereof, while on the other hand, there is described in U.S. Pat. No. 3,726,681 a method for increasing the sensitivity as well as improving the graininess of the dye image by the application of a higher-coupling-reaction-speed coupler to the higher light-sensitive unit emulsion layer and of a lower-coupling-reaction-speed coupler to the lower light-sensitive unit emulsion layer.

In addition, there also have been known such a method as to improve the graininess of a dye image by incorporating into a color photographic light-sensitive material a compound capable of releasing a development inhibiting material in the reaction with the oxidized product of a color developing agent in an alkaline condition.

As compounds of this kind there have been known such compounds as the compound described in, e.g., U.S. Pat. No. 3,148,062 and U.S. Pat. No. 3,227,554, which couples with the oxidized product of a color developing agent to produce a dye as well as to release a development inhibitor (hereinafter referred to as DIR coupler), and the compound described in, e.g., U.S. Pat. No. 3,632,345 which couples with the oxidized product of a color developing agent to release a development inhibitor but not to form a dye (hereinafter referred to as DIR material).

It is well known that the sharpness of a dye image is improved by the adjacency effect at the time of the development thereof. This effect is obtained principally by utilizing the density gradient of the development inhibiting material at the time of the development. Concrete methods of this include the manner that the developing solution is diluted by water, the manner that the stirring of the developing solution is gently effected while in the course of developing, and particularly the well-known method wherein the compound releasing a development inhibiting material in the reaction thereof with the oxidized product of a developing agent is incorporated into a light-sensitive material.

Meanwhile, there has been a strong demand for cameras excellent in portability, and the miniaturization of cameras has been promoted to meet such a demand. However, the use of photographic light-sensitive materials for camera-exposure use in a given size places restrictions on the miniaturization of cameras, so that in order to much further the miniaturization of cameras, the photographic light-sensitive materials for use in camera exposure itself must be made smaller.

A large problem lies in designing the so-called small-format photographic light-sensitive material for camera-exposure use. In the small-format photographic light-sensitive material for camera use, the image frame size thereof is smaller, so that in order to obtain as large a print in size as those ordinary prints, a larger magnification becomes required in enlargement, and accordingly the graininess, resolution and sharpness of the resulting print become much deteriorated; this is particularly remarkable in color photography wherein color images are reproduced. Therefore, there has been a deman for the development of much more excellent technology to reproduce a color image having a dye image excellent in photographic characteristic giving a high image quality, particularly such as the graininess and sharpness.

However, the aforementioned techniques which have been well known are not able to sufficiently satisfy the above described demand. Particularly, with respect to the sharpness, when an attempt was made for the improvement of only the photographic light-sensitive material for printing use in the sharpness thereof, the graininess of the resulting dye image was rather deteriorated. Besides, an attempt to improve the graininess as well as sharpness of the light-sensitive material for camera use alone was neither able to satisfy the foregoing demand.

It is an object of the present invention to provide a method for the reproduction of a color image composed of dyes excellent in both graininess and sharpness, which satisfies the above-described demand.

We, as a result of devoting ourselves to studying collectively the photographic light-sensitive material for camera-exposure use (hereinafter referred to as "color negative") and the photographic light-sensitive material for printing use (hereinafter referred to as "printing light-sensitive material") in order to accomplish the above object, have now recognized that the improvement in both graininess and sharpness has its limits as long as it depends upon such a conventional manner for the reproduction of color images that a color negative having on the transparent support thereof a red-sensitive silver halide emulsion layer in combination with a nondiffusible cyan coupler, a green-sensitive silver halide emulsion layer in combination with a nondiffusible magenta coupler, and a blue-sensitive silver halide emulsion layer in combination with a nondiffusible yellow coupler is imagewise exposed and then processed in the color development procedure to form a dye image composed of yellow, magenta and/or cyan, and subsequently through the color negative having the resulting dye image an exposure is made on a color photographic paper having on the support thereof a red-sensitive silver halide emulsion layer in combination with a nondiffusible cyan coupler, a green-sensitive silver halide emulsion layer in combination with a nondiffusible magenta coupler, and a blue-sensitive silver halide emulsion layer in combination with a nondiffusible yellow coupler, and then the exposed photographic paper is processed in the color development procedure to thereby obtain a color image on the color photographic paper.

After pursueing our studies on the basis of the above knowledge, we have found that the object of the present invention may be attained by the use of the following method for the reproduction of color images:

The method for the reproduction of color images of the present invention is characterized by the formation of a dye image on a photographic printing light-sensitive material in such a manner that a photographic light-sensitive material for camera-exposure use hereinafter mentioned as (A) is imagewisely exposed and processed to form a dye image, and through said photographic light-sensitive material having said image, an exposure is made on a photographic printing light-sensitive material hereinafter mentioned as (B), and said exposed photographic printing light-sensitive material is then processed in an alkaline activator solution to thereby form a dye image thereon.

(A) A photographic light-sensitive material for camera-exposure use: a photographic light-sensitive material comprising a transparent support provided thereon with a red-sensitive silver halide emulsion layer, a green-sensitive silver halide emulsion layer and a blue-sensitive silver halide emulsion layer, said emulsion layers each comprising one of three different couplers selected from nondiffusible couplers capable of forming, by the coupling reaction with the oxidized product of a silver halide developing agent, compounds having spectral absorption maximum wavelength in the wavelength region longer than 340 nm, the spectral absorption maximum wavelength of said compounds beeing at least 30 nm spaced apart from one another, said blue-sensitive silver halide emulsion layer comprising a coupler capable of forming said compound having the highest molecular extinction coefficient among said three different couplers and said green-sensitive silver halide emulsion layer comprising a coupler capable of forming said compound having the lowest molecular extinction coefficient among said three different couplers.

(B) A photographic printing light-sensitive material: a photographic printing light-sensitive material which comprises a support provided thereon with three different light-sensitive silver halide emulsion layers having the respective spectral sensitivity thereof corresponding to the respective absorption maximum wavelength of said compund formed in said photographic light-sensitive material, said three different light sensitive silver halide emulsionl layers each comprising one of three nondiffusible yellow, magenta, and cyan coupler and comprises color developing agent and/or the precursor thereof.

In the present invention, the combination of the foregoing three nondiffusible couplers contained in the three light-sensitive silver halide emulsion layers differing in the color sensitivity of the photographic light-sensitive material for camera-exposure use may be arbitrarily selected from nondiffusible couplers within the range wherein the values of the molecular extinction coefficients of the compounds formed by the reaction of the couplers with the oxidized product of the silver halide developing agent (hereinafter referred to as "coupling reaction product") and the values of the spectral absorption maximum wavelengths satisfy the conditions of the present invention.

The terms "absorption maximum wavelength" and "molecular extinction coefficient" used in the present invention should be understood on the basis of the generally known definitions, such as described in, for example, the Kagaku Daijiten (the Encyclopedia of Chemistry) 2, 812–813, and 8, 185 (1962), published by Kyoritsu Publishing Co., Ltd.

The spectral absorption maximum wave lengths and molecular extinction coefficient of the above coupling reaction products may be obtained by methods known to those skilled in the art, which are described in, e.g., the Shin-Jikkenkagaku-Koza (the New Course of Experimental Chemistry) 4, section "Fundamental Technology Light II", pp 337–393, edited by the Chemical Society of Japan, published by Maruzen Co., Ltd. in 1978, T. H. James edt., the Theory of the Photographic Process, 4th ed. pp. 353–361, P. W. Vittum et al, the Journal of the American Chemical Society 71, 2287–2290 (1949), G. H. Brown et al, ibid, 73, 919–926 (1951), G. H. Brown et al, ibid, 79, 2919–2927 (1957), and G. R. Barr et al, Photographic Science & Engineering, 5, 195–197, and the like.

The red-sensitive silver halide emulsion, green-sensitive silver halide emulsion and blue-sensitive silver halide emulsion of the present invention are those well known to those skilled in the art, which are described in, e.g., J. R. Thirtle, T. H. James edt., the Theory of the Photographic Process, 4th ed., p355–p339. The order of these three emulsion layers to be positioned, although considered discretional, for some reasons important and well-known to those skilled in the art, should be all positioned on a same side of the transparent support and generally be coated on the support in the order, from the exposure side, of the blue-sensitive silver halide emulsion layer, green-sensitive emulsion layer and red-sensitive emulsion layer.

As couplers to be contained in the color negative of the present invention, any compounds are allowed to be used as long as they are capable of coupling with the oxidized product of a developing agent to thereby form coupling reaction products which have the spectral absorption maximum wavelengths longer than 340 nm, and such compounds may be typified by the following:

Typical couplers capable of forming coupling-reaction products having the spectral absorption maximum wavelengths between 350 nm and 500 nm are those known as the so-called yellow coupler among those skilled in the art, which are described in, for example, U.S. Pat. Nos. 2,186,849, 2,322,027, 2,728,658, 2,875,057, 3,265,506, 3,277,155, 3,408,194, 3,415,652, 3,447,928, 3,664,841, 3,770,446, 3,778,277, 3,849,140, 3,894,875, British Pat. Nos. 778,089, 808,276, 875,476, 1,402,511, 1,421,126, and 1,513,832, and Japanese Patent Examined Publication No. 13,576/1974, Japanese Patent Publication Open to Public Inspection (hereinafter referred to as Japanese Patent O.P.I. Publication) Nos. 29,432/1973, 66,834/1973, 10,736/1974, 122,335/1974, 28,834/1975, 132,926/1975, 138,832/1975, 3,631/1976, 17,438/1976, 26,038/1976, 26,039/1976, 50,734/1976, 53,825/1976, 75,521/1976, 89,728/1976, 102,636/1976, 107,137/1976, 117031/1976, 122,439/1976, 143,319/1976, 9,529/1978, 82,322/1978, 135,625/1978, 145,619/1978, 23,528/1979, 48,541/1979, 65,035/1979, 133,329/1979 and 598/1980.

Typical couplers capable of forming coupling reaction products having spectral absorption maximum wavelengths between 500 nm and 600 nm are those known as the so-called magenta coupler among those skilled in the art, which are described in, for example, U.S. Pat. Nos. 1,969,479, 2,213,986, 2,294,909, 2,338,677, 2,340,763, 2,343,703, 2,359,332, 2,411,951, 2,435,550, 2,592,303, 2,600,788, 2,618,641, 2,619,419, 2,673,801, 2,691,659, 2,803,554, 2,829,975, 2,866,706, 2,881,167, 2,895,826, 3,062,653, 3,127,269, 3,214,437, 3,253,924, 3,311,476, 3,419,391, 3,486,894, 3,519,429, 3,558,318, 3,617,291, 3,684,514, 3,705,896, 3,725,067 and 3,888,680, British Pat. Nos. 720,284, 737,700, 813,866, 892,886, 918,128, 1,019,117, 1,042,832, 1,047,612, 1,398,828, and 1,398,979, West German Pat. Nos.

814,996 and 1,070,030, Belgium Pat. No. 724,427, and Japanese Patent O.P.I. Publication Nos. 60,479/1971, 29,639/1974, 111,631/1974, 129,538/1974, 13,041/1975, 116,471/1975, 159,336/1975, 3,232/1976, 3,233/1976, 10,935/1976, 16,924/1976, 20,826/1976, 26,541/1976, 30,228/1976, 36,938/1976, 37,230/1976, 37,646/1976, 39,039/1976, 44,927/1976, 104,344/1976, 105,820/1976, 108,842/1976, 112,341/1976, 112,342/1976, 112,343/1976, 112,344/1976, 117,032/1976, 126,831/1976, 31,738/1977, 9,122/1978, 55,122/1978, 75,930/1978, 86,214/1978, 125,835/1978, 123,129/1978 and 56,429/1979.

Tyical couplers capable of forming coupling reaction products having spectral absorption maximum wavelengths between 600 nm and 750 nm are those known as the so-called cyan coupler among those skilled in the art, which are described in, for example, U.S. Pat. Nos. 2,306,410, 2,356,475, 2,362,598, 2,367,531, 2,369,929, 2,423,750, 2,472,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, British Pat. Nos. 478,991, 945,542, 1,084,480, 1,377,233, 1,388,024 and 1,543,040, and Japanese Patent O.P.I. Publication Nos. 37,425/1972, 10,135/1975, 25,228/1975, 112,038/1975, 117,422/1975, 130,441/1975, 6,551/1976, 37,647/1976, 52,828/1976, 108,841/1976, 109,630/1978, 48,237/1979, 66,129/1979, 131,931/1979 and 32,071/1975.

Those couplers capable of forming coupling reaction products having spectral absorption maximum wavelengths between 700 nm and 850 nm are described in Japanese Patent Examined Publication No. 24,849/1977 and Japanese Patent O.P.I. Publication Nos. 125,836/1978, 129,036/1978, 21,094/1980, 21,095/1980, 21,096/1980 and the like.

Couplers applicable to the respective silver halide emulsion layers of the color negative of the present invention are those three couplers capable of forming coupling reaction products having the spectral absorption maximum wavelengths, each being 30 nm spaced apart from one another, which may be arbitrarily selected from among the above-described known couplers, and a preferred combination of those couplers are the combination of a yellow coupler, a magenta coupler and a cyan coupler selected from the above-described yellow couplers, magenta couplers and cyan couplers, respectively.

A further preferred combination is the combination of a coupler selected from the group consisting of α-benzoyl-acetanilide and α-pivaroylactanilide yellow couplers, a coupler selected from the group consisting of pyrazolotriazole, pyrazolinobenzimidazole, indazolone and 5-pyrazolone, preferably, 1-phenyl-5-pyrazolone magenta couplers, and a coupler selected from α-naphthol cyan couplers.

In the above preferred combination of yellow, magenta and cyan couplers, the comparison of the molecular extinction coefficients thereof enables to provide a preferred embodiment of the color negative of the present invention; the preferred embodiment includes those having a transparent support coated in order thereon with a red-sensitive silver halide emulsion layer containing α-naphthol cyan coupler, a green-sensitive silver halide emulsion layer containing benzoyl-acetanilide or pivaloyl-acetanilide yellow coupler and a blue-sensitive silver halide emulsion layer containing 1-phenyl-5-pyrazolone magenta coupler.

The color negative of the present invention, after the exposure thereof, is subjected to a development, preferably, in a normal manner of color development, thereby obtaining a color image.

The fundamental processes in such a color development method include the color development, bleaching and fixing. There are cases where these fundamental processes each is performed independently, but two or more of them may also be performed at a time with one processing bath having their functions, such as, for example, a color processing monobath containing a color developing agent, ferric-salt bleaching component and thiosulfate fixing component, or a bleach-fixing monobath containing ethylenediamine-tetraacetic acid iron (III) complex salt bleaching component and thiosulfate fixing component.

There are no particular restrictions on the processing of the color negative of the present invention, and various processing procedures may be applied to the processing. For example, any such processing manners are typically applicable as the manner in which after the color development the color negative is subjected to a bleach-fixing treatment, and then, if necessary, to washing and stabilization treatment; the manner in which after the color development the color negative is subjected separately to bleaching and fixing treatments, and, if necessary, further to washing and stabilization treatments; the manner in which the color negative is processed in order in the prehardening, neutralizing, color developing, stop-fixing, washing, bleaching, fixing, washing, post-hardening, and washing baths; the manner in which the negative material is processed in order in the color developing, washing supplemental color developing, stopping, bleaching, fixing, washing and stabilizing baths; the developing manner in which the developed silver produced by the color development is subjected to a halogenation-bleach treatment, and then to the second color development to thereby increase the amount of the dye formed; and the processing manner in which an amplifying agent such as a peroxide, cobalt complex salt and the like is used to process a light-sensitive material with small amount of silver.

As the silver halide developing agent applicable to the color development process in the color processing method, generally an aromatic primary amine color developing agent is used.

The aromatic primary amine color developing agent includes p-phenylenediamine and p-aminophenol, but the former may be more typically used.

As in the printing light-sensitive material which will be hereinafter described, the color developing agent, as it is or in the form of a precursor thereof, may be incorporated into the color negative of the present invention.

In the present invention, the printing light-sensitive material has three different light-sensitive silver halide emulsion layers, each containing one of the yellow, magenta and cyan couplers, respectively. The combination of the light-sensitive silver halide emulsions and the couplers may be selected so that the color negative of the present invention is used to thereby reproduce a color image on the printing light-sensitive material; that is, there are selected the combinations of a cyan coupler with the silver halide emulsion layer of the printing light-sensitive material, the layer having a spectral sensitivity in the spectral absorption maximum wavelength of the coupling reaction product formed from the coupler contained in the red-sensitive silver halide emulsion layer of the color negative of the present invention; of a magenta coupler with the silver halide emulsion layer of the printing light-sensitive material, the layer having a spectral sensitivity in the spectral absorption maximum wavelength of the coupling reaction product formed from the coupler contained in the green-sensitive silver halide emulsion layer of the color negative of the present invention; and of a yellow coupler with the silver halide emulsion layer of the printing light-sensitive material, the layer having a spectral sensitivity in the spectral absorption maximum wavelength of the coupling reaction product formed from the coupler contained in the blue-sensitive silver halide emulsion layer of the color negative of the present invention.

Those couplers applicable to the printing light-sensitive material of the present invention include known yellow, magenta and cyan couplers, such as those described in the previously enumerated patent publications. Preferred magenta couplers are 5-pyrazolone couplers, preferably 1-phenyl-5-pyrazolone couplers, more preferably 1-phenyl-3-anilino-5-pyrazolone couplers and pyrazolotriazole couplers. Preferred yellow couplers are α-pivaloyl-acetanilide couplers. Preferred cyan couplers are phenol couplers. Each of the respective emulsion layers of the color negative and the printing light-sensitive material of the present invention may contain two or more couplers within the range not to hinder the effect of the present invention as long as the couplers are capable of forming coupling compounds having the foregoing characteristics in respect of the spectral absorption maximum wavelength and molar extinction coefficient.

The term "spectral sensitivity" used in the present invention is widely known to those in the art, which, for example, is described in the previously mentioned Kagaku Daijiten (the Encyclopedia of Chemistry) 8, p.185, and the like. The light-sensitive silver halide emulsion having the spectral sensitivity is also well known to those in the art, and may be prepared in the normal manner, which is described in, e.g., the earlier-mentioned "The Theory of the Photographic Process" pp.251–290 and the Society of Photographic Science and Technology of Japan edt. "The Basic Knowledge of Photographic Technology" sec: "Silver Halide Photography" pp.170–188 (published by Corona Co., Ltd. in 1979) and the like.

The printing light-sensitive material of the present invention should essentially have on the support thereof an yellow coupler-containing silver halide emulsion layer, a magenta coupler-containing silver halide emulsion layer and a cyan coupler-containing silver halide emulsion layer, but the order of these layers to be coated on the support is not restricted but may be discretionally selected. The printing light-sensitive material of the present invention contains in the hydrophilic colloidal layers thereof a color developing agent and/or the precursor thereof. Such a color developing agent is typified by aromatic primary amines including aminophenol derivatives and p-phenylenediamine derivatives, which compounds, as they are or in the form of an organic acid salt such as hydrochloride, sulfate, p-toluenesulfonate, tetraphenyl-borate, p-(t-octyl)benzenesulfonate, and the like, may be incorporated into the printing light-sensitive material. Typical examples of such aromatic primary amine color developing agents include o-aminophenol, p-aminophenol, 5-amino-2-oxytoluene, 2-amino-3-oxytoluene, 2-oxy-3-amino-1,4-dimethyl-benzne, N,N-diethyl-p-phenylenediamine hydrochloride, N-methyl-p-phenylenediamine hydrochloride, N,N-dimethyl-p-phenylenediamine hydrochloride, N-ethyl-N-β-methane-sulfonaminoethyl-3-methyl-4-aminoaniline and the sulfate thereof, N-ethyl-N-β-hydroxyethylaminoaniline, N,N-diethyl-3-(β-methanesulfonamidoethyl)-4-aminoaniline-hydrochloride, 4-amino-N-(2-methoxyethyl)-N-ethyl-3-methyl-aniline-p-toluenesulfonate, N-ethyl-N-β-methane-sulfonamidoethyl-3-methyl-4-aminoanilinetetraphenyl-borate, 4-amino-N-(2-methoxyethyl)-N-ethyl-3-methyl-anilinetetraphenyl-borate, p-morpholinoaniline, p-piperidinoaniline, 4-amino-N,N-diethyl-3-chloroaniline, and the like.

The color developing agent precursor to be contained in the printing light-sensitive material of the present invention is a compound capable of producing a color developing agent in an alkaline condition, examples of which compound are aromatic aldehyde derivative Schiff's base type precursors, multivalent metallic ion complex precursors, phthalic acid derivative precursors, phosphoric acid imide derivative precursors, sugar-amine reaction product precursors, urethane-type precursors, and the like.

These aromatic primary amine color developing agent precursors are described in, e.g., U.S. Pat. Nos. 3,342,599, 2,507,114, 2,695,234 and 3,719,492, British Pat. No. 803,784, Japanese Patent O.P.I. Publication Nos. 135,628/1978 and 79,035/1979, and Research Disclosure Nos. 15,159, 12,146 and 13,924.

The following are examples of such precursors:

Exemplified Precursor 1

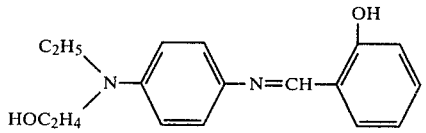

Exemplified Precursor 2

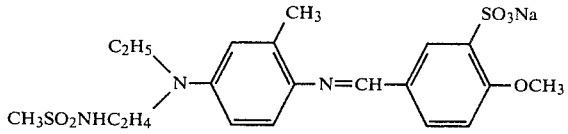

Exemplified Precursor 3

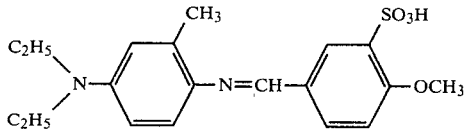

Exemplified Precursor 4

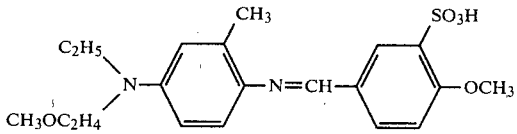

Exemplified Precursor 5

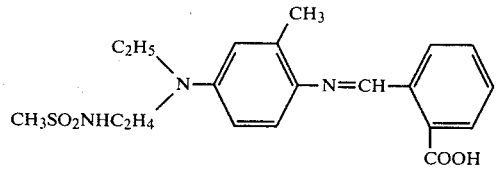

-continued

Exemplified Precursor 6

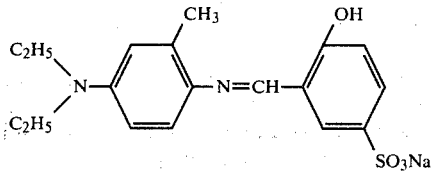

Exemplified Precursor 7

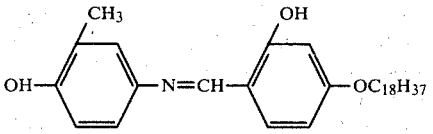

Exemplified Precursor 8

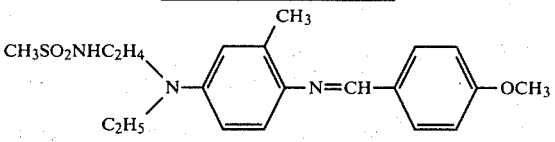

Exemplified Precursor 9

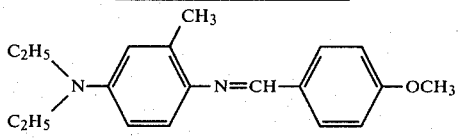

Exemplified Precursor 10

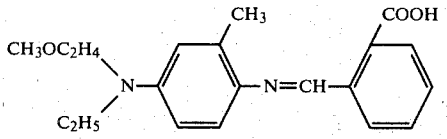

Exemplified Precursor 11

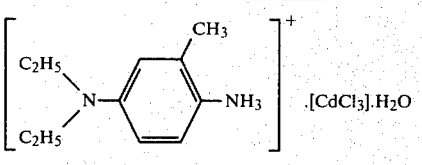

Exemplified Precursor 12

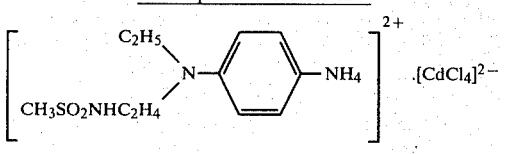

Exemplified Precursor 13

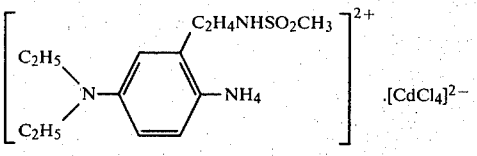

Exemplified Precursor 14

The reaction product of

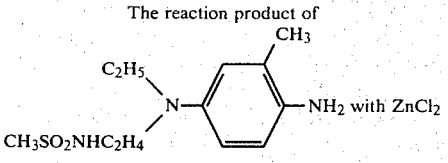

-continued

Exemplified Precursor 15

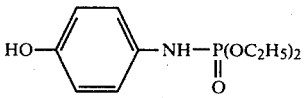

Exemplified Precursor 16

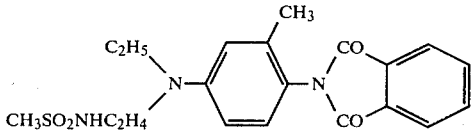

Exemplified Precursor 17

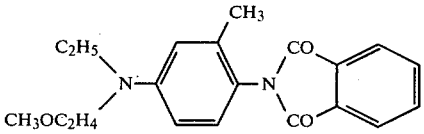

Exemplified Precursor 18

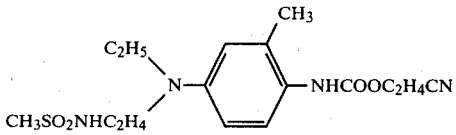

Exemplified Precursor 19

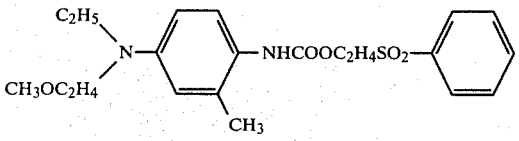

Into the printing light-sensitive material of the present invention should be incorporated one of these aromatic primary amine color developing agents or the precursors thereof in as much the quantity as necessary to form sufficient in the activator processing. The quantity largely varies according to the kind of the printing light-sensitive material used, but should be approximately between 0.1 mol and 5 mols, preferably between 0.5 mol and 3 mols per mol of the light-sensitive silver halide.

These color developing agents or the precursors thereof may be used singly or in combination. In adding to the printing light-sensitive material, the agent or the precursor thereof may be added in the form of a solution of it dissolved into an appropriate solvent such as water, methanol, ethanol, acetone, dimethyl-formamide, or the like or in the form of an emulsifiedly dispersed liquid thereof prepared by use of a high boiling organic solvent such as dibutyl phosphate, dioctyl phthalate, tricresyl phosphate or the like, or further, may be impregnated into a latex polymer to be added as is described in Research Disclosure No. 14,850.

Into the printing light-sensitive material may be incorporated a cyclic $\beta$-dicarbonyl compound described in Japanese Patent O.P.I. Publication No. 111729/1978 in order to prevent the deterioration of the sensitivity as well as of the color density and the occurrence of stain on the material.

Furthermore, it is desired that the printing light-sensitive material also contain an auxiliary developing agent for the acceleration of the color developing reaction. A preferred typical auxiliary developing agent is a 1-aryl- 3-prazolidone derivative, examples of which include the following compounds:

AP-1: 1-phenyl-3-pyrazolidone
AP-2: 1-(p-tolyl)-3-pyrazolidone
AP-3: 4,4-dimethyl-1-phenyl-3-pyrazolidone
AP-4: 4-methyl-4-hydroxymethyl-1-phenyl-3-pyrazolidone
AP-5: 4-methyl-4-hydroxymethyl-1-tolyl-3-pyrazolidone
AP-6: 4-methyl-4-acetoxymethyl-1-phenyl-3-pyrazolidone
AP-7: 4-methyl-4-benzoyl-oxymethyl-1-phenyl-3-pyrazolidone.

The printing light-sensitive material of the present invention containing a color developing agent, after being imagewise exposed through a color negative having an image formed of the coupling reaction product, is processed in an activating bath. The alkaline activating treatment used in the present invention is characterized by using a liquid known as the so-called activator which is an alkaline solution substantially free of any color developer agents instead of using the color developing agent solution in the foregoing color developing method, the activator being widely known as suitable for processing silver halide photographic light-sensitive materials containing color developing agents. Such alkaline activating processing which uses an activator liquid to process silver halide photographic light-sensitive materials containing a developing agent or the precursor thereof to give a dye image is described in, e.g., U.S. Pat. Nos. 3,342,597 and 3,719,492, Research Disclosure Nos. 12,146, 13,924 and 14,850, and Japanese Patent O.P.I. Publications Nos. 111,729/1978 and 135,628/1978.

The activator solution applicable to the present invention is basically an alkaline aqueous solution free of an aromatic primary amine color developing agent, but has the possibility of containing the color developing agent that is possibly dissolved out into from the exposed printing light-sensitive material during the processing thereof. In the activator solution the concentration of the color developing agent dissolved thereinto varies according to the quantity of the color developing agent in advance contained in the printing light-sensitive material, the quantity of the activator solution, the quantity of the printing light-sensitive material to be processed, the replenishing quantity of the activator solution, the rate of the developing agent to be dissolved into from the printing light-sensitive material during the processing thereof, and the like, but it is desirable that the pH, temperature, the quantity of a development inhibitor and the like be controlled so that the development reaction during the processing in the activator is substantially not affected by the quantity of the color developing agent dissolved into the activator solution.

The activator solution in the present invention contains such an alkali agent as potassium hydroxide, sodium hydroxide, sodium carbonate, potassium carbonate, sodium triphosphate, potassium triphosphate; a sulfite such as sodium sulfite, potassium sulfite; and a bromide such as sodium bromide, potassium bromide, ammonium bromide, and further, if necessary, may also contain a known development inhibitor; a thiocyanate such as sodium thiocyanate, potassium thiocyanate, ammonium thiocyanate; a chloride such as ammonium chloride, potassium chloride, sodium chloride; an organic solvent such as ethylene glycol, diethylene glycol, methanol, ethanol, n-butanol, benzyl alcohol, acetone, dimethyl formamide; an amine such as hydroxylamine, ethanolamine, ethylenediamine, diethanolamine; a water softener such as sodium hexametaphosphate, sodium tripolyphosphate, ethylenediamine tetraacetic acid, diethylenetriamine pentaacetic acid; and a water-soluble optical whitening agent.

The activator solution of the present invention may also contain an auxiliary developing agent. A preferred auxiliary developing agent is a 1-aryl-3-pyrazolidone derivative, which may be used within the range of from 1 mg to 1 g, preferably from 10 mg to 500 mg per liter of the activator solution. Typical examples of the auxiliary developing agent include 1-phenyl-3-pyrazolidone, 4-methyl-1-phenyl-3-pyrazolidone, 4,4-dimethyl-1-phenyl-3-pyrazolidone, 4-methyl-4-hydroxymethyl-1-phenyl-3-pyrazolidone, 4-methyl-4-hydroxymethyl-1-(p-tolyl)-3-pyrazolidone, and the like.

The activator solution of the present invention is maintained alkaline in the normal manner, and the hydrogen ion concentration thereof may be selected arbitrarily according to the kind, composition, purpose and use of the printing light-sensitive material of the present invention, but is generally from pH 9.5 to pH 13.5, preferably from pH 10.5 to pH 13.0, the range giving satisfactory results.

The activator solution of the present invention is used generally in a certain temperature range. The temperature range is arbitrarily selectable according to the kind, composition, use and purpose of the printing light-sensitive material of the present invention to be processed and should be preferably from 15° C. to 70° C., more preferably from 30° C. to 50° C.

The printing light-sensitive material of the present invention, after being processed in the activator solution, is further processed in the subsequent baths in the normal manner, thereby obtaining a dye image. The alkaline activating processing basically includes the developing process, bleaching process and fixing process by the activator solution.

The developing process, bleaching process and fixing process by the activator solution, although each of the processes may be separately carried out, may also be performed at a time in a monobath having their functions instead of carrying out the processes separately, the monobath being typified by, e.g., a monobath of activator containing both a bleaching agent and a fixing agent which will be hereinafter illustrated; a bleach-fixing solution containing a bleaching agent and a fixing agent, and the like, the latter being widely used and known as the "bleach-fixing bath", which may be preferably used also in the present invention.

As the bleaching agent applicable to such a bleach-fixing bath, known compounds may be used, the compounds including aminopolycarboxylic acid ferric complex salts such as, e.g., ethylenediamine tetraacetic acid ferric sodium salt, ethylenediamine tetraacetic acid ferric ammonium salt, and the like; persulfates such as ammonium persulfate, sodium persulfate, and the like. As the fixing agent applicable to the bleach-fixing bath there may be used known compounds which include thiosulfates such as, e.g., sodium thiosulfate, ammonium thiosulfate, and the like; water-soluble sulfur-containing diols such as 3,6-dithia-1, 8-octanediol, 3,6,9,12-tetrathia-1, 14-tetradecanediol, and the like; water-soluble sulfur-containing dibasic acids such as ethylene-bis-thioglycolic acid, ethylene-bis-thioglycolic acid sodium salt, 3,6,9-trithiahendecanedioic acid, and the like.

The printing light-sensitive material containing the color developing agent or the precursor thereof of the present invention, after being imagewise exposed and then processed in the activator solution, may be immediately processed in the bleach-fixing bath to be desilvered, but may also be immersed in an acid stop bath provided between the activator and bleach-fixing baths. Such an acid stop bath may be an aqueous solution containing acetic acid or citric acid. Further, if necessary, prehardening, neutralizing, washing, stabilizing processes, etc., may also be additionally provided for the processing of the printing light-sensitive material of the present invention.

The quantities of the nondiffusible couplers to be contained in the color negative and printing light-sensitive material of the present invention are generally from $1\times10^{-3}$ mol to $5\times10^{-1}$ mol, preferably from $1\times10^{-2}$ mol to $5\times10^{-1}$ mol per mol of the silver in the light-sensitive silver halide emulsion layer.

For dispersing the nondiffusible coupler an appropriate process may be discretionally selected, according to the chemical structure and the like of the nondiffusible coupler to be used, from among the so-called alkaline solution dispersion process, solid dispersion process, latex dispersion process, oil-in-water type emulsification dispersion process, and the like.

In the present invention, the latex dispersion process or the oil-in-water type emulsification dispersion process may be particularly effectively used. These dispersion processes have been well known, and the latex dispersion process and the effect thereof are described in Japanese Patent O.P.I. Publications Nos. 74,538/1974, 59,943/1976 and 32,552/1979, and Research Disclosure No. 14,850 pp. 77–79 (August 1976).

Preferred latex materials are the homopolymers, copolymers and terpolymers from such monomers as, e.g., styrene, ethyl acrylate, n-butyl acrylate, n-butyl methacrylate, 2-acetacetoxyethyl methacrylate, 2-(methacryloyloxy)ethyl-trimethyl-ammonium metasulfate, 3-(methacryloyloxy)propane-1-sulfonic acid sodium salt, n-isopropyl-acrylamide, N-[2-(2-methyl-4-oxobenzyl)-]acrylamide, 2-acrylamide-2-methyl-propane-sulfonic acid, and the like. As the oil-in-water type emulsification dispersion process there may be used such a conventionally known manner for the dispersion of hydrophobic additives such as couplers that, for example, the above nondiffusible coupler is dissolved into a high-boiling solvent such as N-n-butyl acetanilide, diethyl lauramide, dibutyl phthalate, tricresyl phosphate, N-dodecyl pyrolidone, and the like, and the solution is then finely dispersed into a hydrophilic colloid such as gelatin.

Those silver halides for use in the silver halide emulsion layers of the color negative and the printing light-sensitive material of the present invention include those discretionally applicable to normal silver halide photographic emulsions such as silver chloride, silver bromide, silver iodide, silver chlorobromide, silver iodobromide, silver chloroiodide, and the like.

The particles of these silver halides may be either coarse-grained or fine-grained, and the distribution of the particle sizes may be in either a wider or narrower range. In addition, the crystals of these silver halide particles may be of either the normal or the twin, and there may be used those crystals having the discretional crystal face ratio of [100] to [111]. Further, these silver halide particles may be of either the crystal uniformly structured from the inside through the outside thereof or the crystal heterogeneously stratified with the inside and the outside thereof. Furthermore, these silver halides may be of either the type forming a latent image on the surface thereof or the type forming a latent image internally.

These silver halide particles may be prepared in the known manner customarily used among those skilled in the art.

These silver halide emulsions used in the present invention may preferably be free of water-soluble salts, but may be allowed to contain the water-soluble salt remaining unremoved. In addition, two or more different emulsions separately prepared may be mixed to be used.

As the binder for the emulsion layers of the color negative and the printing light-sensitive material of the present invention there may be used those conventionally known materials including gelatin and the derivatives thereof such as phenyl-carbamylated gelatin, acylated gelatin, phthalated gelatin, and the like. These binders may, if necessary, be used in the form of a compatible mixture of two or more kinds thereof.

The silver halide photographic emulsion prepared by dispersing the above-mentioned silver halide particles into a binder solution may be sensitized by the addition of chemical sensitizers. Those chemical sensitizers advantageously usable in combination in the present invention may be classified into four: noble metal sensitizers, sulfur sensitizers, selenium sensitizers and reduction sensitizers.

As the noble metal sensitizer there may be used compounds of gold, ruthenium, rhodium, palladium, iridium, platinum, and the like.

In addition, when using a gold compound, ammonium thiocyanate and sodium thiocyanate may be used together therewith.

As the sulfur sensitizer, in addition to the active gelatin, sulfur compounds may be used.

As the selenium sensitizer there may be used either active or inert selenium compounds.

The reduction sensitizer includes monovalent tin salts, polyamines, bisalkylaminosulfides, silane compounds, isinoaminomethane-sulfinic acid, hydrazinium salts and hydrazine derivatives.

For the color negative and the printing light-sensitive material of the present invention there may be used, in addition to the foregoing additives, such various additives useful for photographic light-sensitive materials as stabilizing agents, development accelerating agents, hardening agents, surfactants, antistain agents, lubricants, ultraviolet absorbing agents, the previously mentioned DIR compounds, color-compensating colored couplers, and the like. Furthermore, the color negative may also contain color-compensating colored couplers.

The color negative and the printing light-sensitive material of the present invention may be arbitrarily provided with, in addition to the silver halide emulsion layers, such auxiliary layers as a protective layer, interlayers, filter layers, an antihalation layer, a backing layer, and the like.

As the support of the color negative and the printing light-sensitive material of the present invention there may be used by arbitrarily selecting according to purposes such conventionally known materials as plastic film, plastic-laminated paper, baryta paper, synthetic paper, and the like, and these supports generally are coated with a subbing layer in order to increase the adhesion of the photographic emulsion layer with the support. As the support of the printing light-sensitive material either a transparent or reflective material may be used, selecting according to purposes.

In the novel method for the reproduction of a color image of the present invention, although various embodiments thereof may be considered, most preferred embodiment is a method in which the following photographic light-sensitive material for camera-exposure use is imagewise exposed and then processed in accordance with the color development process thereby to form an image composed of at least one kind coupling reaction product having a spectral absorption maximum wavelength longer than 340 nm, and after that, through the photographic material having the resulting image an exposure is made on the following photographic printing light-sensitive material, which is then subjected to an alkaline activator processing, thereby forming a dye image.

Photographic light-sensitive material for camera-exposure use

A color photographic light-sensitive material for camera-exposure use having on the support thereof in order a nondiffusible α-naphthol cyan coupler-containing red-sensitive silver halide emulsion layer, a nondiffusible α-acylacetanilide yellow coupler-containing green-sensitive silver halide emulsion layer and a nondiffusible 1-phenyl-5-pyrazolone magenta coupler-containing blue-sensitive silver halide emulsion layer.

Printing light-sensitive material

A printing light-sensitive material having on the support thereof a nondiffusible phenol cyan coupler-containing red-sensitive silver halide emulsion layer, a nondiffusible α-pivaloylacetanilide yellow coupler-containing green-sensitive silver halide emulsion layer and a nondiffusible 1-phenyl-3-anilino-5-pyrazolone or pyrazolotraizole magenta coupler-containing blue-sensitive silver halide emulsion layer and, besides, the material containing a color developing agent and/or the precursor thereof.

The present invention has enabled to reproduce on the printing light-sensitive material an image excellent in both graininess and sharpness, thus enabling the use of miniature cameras without deteriorating the image quality.

Examples of the present invention are illustrated below, but the present invention is not limited thereto.

EXAMPLE 1

A color negative-1 was prepared by coating in order the following layers on a subbed transparent cellulose triacetate film support (in all the examples hereinafter described, the adding quantities of additives to the silver halide color photographic light-sensitive material are shown in the quantities per $m^2$ and those of the silver halides as well as of the colloidal silver are shown in silver equivalent).

Color Negative-1

Layer 1: An antihalation layer containing 0.4 g of black colloidal silver and 3 g of gelatin.

Layer 2: A low-speed red-sensitive emulsion layer containing 1.5 g of a low-speed red-sensitive silver iodobromide emulion (AgI: 4 mol%), 1.6 g of gelatin and 0.4 g of tricresyl phosphate (hereinafter abbreviated to TCP) into which were dissolved the following couplers and a DIR material: 0.80 g of 1-hydroxy-4-(β-methoxyethylaminocarbonylmethoxy)-N-[δ-(2,4-di-t-amyl-phenoxy)butyl]-2-naphthoamide (cyan coupler C-1), 0.08 g of 1-hydroxy-4-[4-(1-hydroxy-8-acetamide-3,6-disulfo-2-naphthylazo)phenoxy]-N-[δ-(2,4-di-t-amyl-phenoxy)butyl-2-naphthoamide]-disodium salt (colored cyan coupler CC-1) and 0.018 g of α-(1-phenyl-5-tetrazolylthio)-4-octadesenyl-succinimide-1-indanone (DIR material D-1).

Layer 3: A high-speed red-sensitive emulsion layer containing 1.1 g of a high-speed red-sensitive silver iodobromide emulsion (AgI: 7 mol%), 1.2 g of gelatin and 0.15 g of TCP into which were dissolved the following couplers and DIR material: 0.23 g of cyan coupler C-1, 0.020 g of colored cyan coupler CC-1 and 0.013 g of DIR material D-1.

Layer 4: An interlayer containing 0.04 g of di-n-butyl phthalate (hereinafter abbreviated to DBP) into which was dissolved 0.07 g of 2,5-dioctyl hydroquinone (antistain agent HQ-1), and 1.2 g of gelatin.

Layer 5: A low-speed green-sensitive emulsion layer containing 1.6 g of a low-speed green-sensitive silver iodobromide emulsion (AgI: 5 mol%), 1.7 g of gelatin and 0.3 g of TCP into which were dissolved the following couplers and a DIR material: 0.30 g of 1-(2,4,6-trichlorophenyl)-3-[3-(2,4-di-t-amyl-phenoxyacetamide)benzeneamide]-5-pyrazolone (magenta coupler M-1), 0.20 g of 4,4'-methylene-bis-{1-(2,4,6-trichlorophenyl)-3-[3-(2,4-di-t-amyl-phenoxyacetamide]benzenamide]-5-pyrazolone (magenta coupler M-2}, 0.066 g of 1-(2,4,6-trichlorophenyl)-4-(1-naphthylazo)-3-(2-chloro-5-octadesenyl-succinimideanilino)-5-pyrazolone (colored magenta coupler CM-1) and 0.025 g of 2-(1-phenyl-5-tetrazolylthio)-4-(2,4-di-t-amyl-phenoxyacetanilide)-1-indanone (DIR material D-2).

Layer 6: A high-speed green-sensitive emulsion layer containing 1.5 g of a high-speed green-sensitive silver iodobromide emulsion (AgI: 7 mol%), 1.9 g of gelatin and 0.12 g of TCP into which were dissolved the following couplers and a DIR material: 0.093 g of magenta coupler M-1, 0.094 g of magenta coupler M-2, 0.04 g of colored magenta coupler CM-1, and 0.008 g of DIR material D-2.

Layer 7: A yellow filter layer containing 0.2 g of yellow colloidal silver, 0.11 g of DBP into which was dissolved 0.2 g of antistain agent HQ-1, and 2.1 g of gelatin.

Layer 8: A low-speed blue-sensitive emulsion layer containing 0.95 g of a low-speed blue-sensitive silver iodobromide emulsion (AgI: 4 mol%), 1.9 g of gelatin, and 0.93 g of DBP into which were dissolved the following coupler and DIR material: 1.84 g of α-[4-(1-benzyl-2-phenyl-3,5-dioxo-1,2,4-triazolidinyl)]-α-pivaloyl-2-chloro-5-[γ-(2,4-di-t-amylphenoxy)-butaneamide]acetanilide (yellow coupler Y-1) and 0.025 g of DIR material D-2.

Layer 9: A high-speed blue-sensitive emulsion layer containing 1.2 g of a high-speed blue-sensitive silver iodobromide emulsion (AgI: 7 mol%), 2.0 g of gelatin and 0.23 g of DBP into which were dissolved the following materials: 0.46 g of yellow coupler Y-1 and 0.008 g of DIR material D-2.

Layer 10: A protective layer containing 0.23 g of gelatin.

On the other hand, a color negative-2 of the present invention having blue-sensitive emulsion layer containing magenta couplers and green-sensitive emulsion layers containing yellow couplers was prepared in the manner similar to that color negative-1 of the present invention. The following layers were coated in order on a transparent support as described below:

Color Negative-2

Layer 1: Identical with the layer 1 of color negative-1.
Layer 2: Identical with the layer 2 of color negative-1.
Layer 3: Identical with the layer 3 of color negative-1.
Layer 4: Identical with the layer 4 of color negative-1.
Layer 5: A low-speed green-sensitive emulsion layer containing 1.05 g of a low-speed green-sensitive silver iodobromide emulsion (the same as the emulsion used in the layer 5 of color negative-1), 1.7 g of gelatin and 0.93 g of DBP into which were dissolved the following coupler and DIR material: 1.84 g of yellow coupler Y-1 and 0.025 g of DIR material D-2.
Layer 6: A high-speed green-sensitive emulsion layer containing 1.35 g of a high-speed green-sensitive silver iodobromide emulsion (the same as the emulsion used in the layer 6 of negative color-1), 1.9 g of gelatin and 0.23 g of DBP into which were dissolved the following coupler and DIR material: 0.46 g of yellow coupler Y-1 and 0.008 g of DIR material D-2.
Layer 7: An yellow filter layer containing 0.15 g of yellow colloidal silver and DBP into which was dissolved 0.2 g of antistain agent HQ-1, and 2.1 g of gelatin.
Layer 8: A low-speed blue-sensitive emulsion layer containing 1.55 g of a low-speed blue-sensitive silver iodobromide emulsion (the same as the emulsion used in the layer 8 or color negative-1), 1.9 g of gelatin and 0.3 g of TCP into which were dissolved the following couplers and DIR material: 0.30 g of magenta coupler M-1, 0.20 g of magenta coupler M-2, 0.066 g of colored magenta coupler CM-1 and DIR material D-2.
Layer 9: A high-speed blue-sensitive emulsion layer containing a high-speed blue-sensitive silver iodobromide emulsion (the same as the emulsion used in the layer 9 of the color negative-1), 2.0 g of gelatin and 0.12 g of TCP into which were dissolved the following couplers and DIR material: 0.093 g of magenta coupler M-1, 0.094 g of magenta coupler M-2, 0.049 g of colored magenta coupler and 0.008 g of DIR material D-2.
Layer 10: Identical with the layer 10 of color negative-1.

In addition, the absorption maximum wavelengths and the molecular extinction coefficients of the dyes formed by the coupling reactions of the respective couplers used in the color negative with the oxidized product of the developing agent 4-amino-3-methyl-N-ethyl-N-(β-hydroxyethyl) aniline were determined in the manner that the formed dye is dissolved into a solvent mixture of ethyl acetate with n-butanol (1:1) to form a $5\times10^{-3}$ M solution, and the solution is subjected to the measurement by means of a Hitachi Spectrophotometer Type 556 (manufactured by Hitachi, Ltd.). The obtained results are shown in Table 1.

TABLE 1

| Nondiffusible coupler | Absorption max wavelength | Molecular extinction coefficient |
|---|---|---|
| C - 1 | 696 nm | $2.4\times10^4$ |
| CC - 1 | 696 nm | $2.4\times10^4$ |
| M - 1 | 563 nm | $4.6\times10^4$ |
| M - 2 | 563 nm | $4.6\times10^4$ |
| CM - 1 | 546 nm | $5.7\times10^4$ |
| Y - 1 | 448 nm | $1.3\times10^4$ |

On the other hand, a printing light-sensitive material-1 was prepared by coating in order the following six layers on a corona-discharge-treated polyethylene-coated paper support:

Printing Light-Sensitive Material-1

Layer 1: A blue-sensitive emulsion layer containing 0.45 g of a blue-sensitive silver chlorobromide emulsion (mean particle size: 0.65 μm, AgBr: 60 mol%), 1.47 g of gelatin and 0.4 g of DBP into which were dissolved the following materials: 0.8 g of α-[3-(1-benzyl-2,4-dioxo-1,3-imidazolidinyl)]-α-pivaloyl-2'-chloro-5'-[4-(2,4-di-t-amyl-phenoxy)-butaneamide]acetanilide (yellow coupler Y-2), 0.05 g of 5,5-dimethyl-1,3-cyclohexanedione (hereinafter abbreviated to DMCH) and 0.015 g of antistain agent HQ-1.
Layer 2: A first interlayer containing 1.03 g of gelatin, 0.03 g of DBP into which is dissolved 0.05 g of antistain agent HQ-1, and 0.065 g of 4-methyl-4-hydroxymethyl-1-phenyl-3-pyrazolidone (hereinafter abbreviated to MHPP).
Layer 3: A green-sensitive emulsion layer containing 0.40 g of a green-sensitive silver chlorobromide emulsion (mean particle size: 0.49 μm, AgBr: 65 mol%), 1.85 g of gelatin and 0.34 g of TCP into which were dissolved the following materials: 0.63 g of 3-[2-chloro-5-(1-octadesenylsuccinimide)anilino]-1-(2,4,6-trichlorophenyl)-5-pyrazolone (magenta coupler M-3), 0.05 g of DMCH and 0.015 g of antistain agent HQ-1.
Layer 4: A second interlayer containing 1.45 g of gelatin, 0.03 g of MHPP and 0.22 g of DBP into which were dissolved the following materials: 0.2 g of 2-(2-hydroxy-3,5-di-t-butyl-phenyl)-benzotriazole (ultraviolet absorbing agent UV-1), 0.3 g of 2-(2-hydroxy-5-t-butyl-phenyl)-benzotriazole (ultraviolet absorbing agent UV-2) and 0.05 g of antistain agent HQ-1.
Layer-5: A red-sensitive emulsion layer containing 0.30 g of a red-sensitive silver chlorobromide emulsion (mean particle size: 0.40 μm, AgBr: 75 mol%), 1.6 g of gelatin and 0.3 g of DBP into which were dissolved the following materials: 0.42 g of 2-[2-(2,4-di-t-amyl-phenoxy) butaneamide]-4,6-di-chloro-5-methyl-phenol (cyan coupler C-2), 0.05 g of DMCH and 0.005 g of antistain agent HQ-1.
Layer 6: A protective layer containing 0.04 g of MHPP and 1.8 g of gelatin.

A printing light-sensitive material-2 to be subjected to activator color processing was prepared in the same condition as in printing light-sensitive material-1 with the exception that 0.7 g of exemplified precursor-8 was added immediately before coating to each of the layer 1, layer 2 and layer 3 of printing light-sensitive material-1.

Further, a printing light-sensitive material-3 containing a color developing agent precursor, intended to be printed from color negative-2 of the present invention, was prepared by coating in order the following six layers on a corona-discharge-treated polyethylene-coated paper support:

Printing Light-Sensitive Material-3

Layer 1: A blue-sensitive emulsion layer containing 0.4 g of a blue-sensitive silver chlorobromide emulsion (the same as the emulsion used in the layer 1 of printing light-sensitive material-2); 1.47 g of gelatin; and 0.43 g of TCP into which were dissolved the following materials: 0.63 g of magenta coupler M-3, 0.05 g of DMCH and 0.015 g of antistain agent HQ-1; and further containing 0.7 g of exemplified precursor-8.

Layer 2: Identical with the layer 2 of printing light-sensitive material-1.

Layer 3: A green-sensitive emulsion layer containing 0.45 g of a green-sensitive silver chlorobromide emulsion (the same as the emulsion used in the layer 3 of printing light-sensitive material-2); 1.85 g of gelatin; and 0.4 g of DBP into which were dissolved the following materials: 0.8 g of yellow coupler Y-2, 0.05 g of DMCH and 0.015 g of antistain agent HQ-1; and further containing 0.7 g of exemplified precursor-8.

Layer 4: Identical with the layer 4 of printing light-sensitive material-1.

Layer 5: Identical with the layer 5 of printing light-sensitive material-2.

Layer 6: Identical with the layer 6 of printing light-sensitive material-1.

Printing light-sensitive-1 is of the conventional type in which the color sensitivity of each of the silver halide emulsions thereof is in the complementary color relation with the absorption wavelength region of the dye formed from the coupler contained in each of said silver halide emulsions, which is processed in a color developing solution to thereby form a dye image. Printing light-sensitive material-2, on the other hand, has the same emulsion-coupler combination as that of printing light-sensitive material-1, but the former differs from the latter in respect that the former forms a dye image by being processed with an activator.

Printing light-sensitive materials-1 and -2 are so designed as to produce a color image through a printing procedure from color negative-1, while printing light-sensitive material-3 is the material of the present invention so designed as to obtain a color image through a printing procedure from color negative-2, the color image being formed by an alkaline activator processing. The prepared printing light-sensitive materials-1, -2 and -3 each was brought into close contact with a transparent square wave chart to be exposed to the respective monochromatic blue, green and red lights and then processed in the following processing steps, whereby samples having dye images were obtained.

| Printing light-sensitive material-1: | | |
|---|---|---|
| Color developing (A) | at 33° C. | 3 minutes 30 seconds |
| Bleach-fixing | at 33° C. | 1 minute 30 seconds |
| Washing | at a temperature between 30 and 34° C. | 3 minutes |
| Drying | | |

| Printing light-sensitive materials-2 and -3: | | |
|---|---|---|
| Activator processing | at 33° C. | 1 minute |
| Bleach-fixing | at 33° C. | 1 minute 30 seconds |
| Washing | at a temperature between 30 and 34° C. | 3 minutes |
| Drying | | |

The compositions of the processing baths used in the respective processing steps are as follows:

| Color developing solution (A): | |
|---|---|
| Pure water | 800 ml |
| Ethylene glycol | 15 ml |
| Benzyl alcohol | 18 ml |
| Hydroxylamine sulfate | 2.0 g |
| Anhydrous potassium carbonate | 30.0 g |
| Potassium bromide | 0.5 g |
| Sodium chloride | 1.5 g |
| Anhydrous potassium sulfite | 2.0 g |
| N—ethyl-N—β-methanesulfonamide-ethyl-3-methyl-4-aminoaniline sulfate | 4.5 g |
| Add pure water to make 1 liter | |
| Potassium hyroxide or sulfuric acid is added to the solution to adjust the pH thereof to 10.2 | |

-continued

| Activator solution: | |
|---|---|
| Pure water | 800 ml |
| Ethylene glycol | 15 ml |
| Benzyl alcohol | 15 ml |
| Hydroxylamine sulfate | 2.0 g |
| Anhydrous potassium carbonate | 50.0 g |
| Potassium bromide | 0.1 g |
| Anhydrous potassium sulfite | 2.0 g |
| Add pure water to make 1 liter | |
| Potassium hydroxide or sulfuric acid is added to the solution to adjust the pH thereof to 12.0 | |

| Bleach-fixing solution: | |
|---|---|
| Pure water | 750 ml |
| Iron(III)-sodium ethylenediamine-tetraacetate | 50 g |
| Ammonium thiosulfate | 85 g |
| Sodium hydrogensulfite | 10 g |
| Sodium metabisulfite | 2 g |
| Disodium ethylenediamine-tetraacetate | 20 g |
| Sodium bromide | 3.0 g |
| Add pure water to make 1 liter | |
| Aqueous ammonia or sulfuric acid is added to the solution to adjust the pH thereof to 7.0 | |

The obtained samples each was measured by means of a SAKURA Microdensitometer Model PDM-5 Type AR (manufactured by Konishiroku Photo Industry Co., Ltd.) to determine the MTF (Modulation Transfer Function) in each spatial frequency. Table 2 shows the values of the MTF in the spatial frequencies of 3 lines/mm and 5 lines/mm with respect to the foregoing three printing light-sensitive materials.

TABLE 2

| | Exposed to blue light | | Exposed to green light | | Exposed to red light | |
|---|---|---|---|---|---|---|
| Spatial frequency | 3 lines | 5 lines | 3 lines | 5 lines | 3 lines | 5 lines |
| Printing light-sensitive material-1 | 0.52 | 0.39 | 0.48 | 0.32 | 0.50 | 0.36 |
| Printing light-sensitive material-2 | 0.64 | 0.49 | 0.61 | 0.43 | 0.62 | 0.44 |
| Printing light-sensitive material-3 | 0.62 | 0.48 | 0.63 | 0.42 | 0.61 | 0.45 |

Table 2 shows that printing light-sensitive materials-2 and -3, when processed in the activator solution, are remarkably improved in the sharpness thereof.

On the other hand, color negatives-1 and -2 were exposed through an optical wedge to white light, and then processed in accordance with the following steps:

| Processing steps | Processing period |
|---|---|
| Color developing | 3 minutes 15 seconds |

-continued

| Processing steps | Processing period |
|---|---|
| Bleaching | 6 minutes 30 seconds |
| Washing | 3 minutes 15 seconds |
| Fixing | 6 minutes 30 seconds |
| Washing | 3 minutes 15 seconds |
| Stabilizing | 1 minute 30 seconds |
| Drying | |

The compositions of the processing solutions used in the respective processing steps are as follows:

| Color developing solution: | |
|---|---|
| 4-amino-3-methyl-N—ethyl-N—(β-hydroxyethyl)-aniline sulfate | 4.8 g |
| Anhydrous sodium sulfate | 0.1 g |
| Hydroxylamine ½ sulfate | 1.98 g |
| Sulfuric acid | 0.74 mg |
| Anhydrous potassium carbonate | 28.85 g |
| Anhydrous potassium hydrogencarbonate | 3.46 g |
| Anhydrous potassium sulfite | 5.10 g |
| Potassium bromide | 1.16 g |
| Sodium chloride | 0.14 g |
| Trisodium nitrilotriacetate, monohydrated | 1.20 g |
| Potassium hydroxide | 1.48 g |
| Water to make 1 liter | |

| Bleaching solution: | |
|---|---|
| Iron(III)-ammonium ethylenediamine tetraacetate | 100.0 g |
| Diammonium ethylenediamine tetraacetate | 10.0 g |
| Ammonium bromide | 150.0 g |
| Glacial acetic acid | 10.0 ml |
| Water to make 1 liter | |
| Aqueous ammonia is added to the solution to adjust the pH of the solution to 6.0 | |

| Fixing Solution: | |
|---|---|
| Ammonium thiosulfate | 175 g |
| Anhydrous sodium sulfite | 8.6 g |
| Sodium metasulfite | 2.3 g |
| Water to make 1 liter | |
| Acetic acid is added to the solution to adjust the pH thereof to 6.0 | |

| Stabilizing solution: | |
|---|---|
| Formalin (37% aqueous solution) | 1.5 ml |

-continued

| Stabilizing solution: | |
|---|---|
| Koniducks (manufactured by Konishiroku Photo Industry Co., Ltd.) | 7.5 ml |
| Water to make 1 liter | |

The obtained samples measured for the densities thereof in the normal manner showed that color negatives-1 and -2 have nearly the same gradation and fog.

Subsequently, color negative-1 and color negative-2 were used to photograph various subjects and then processed in accordance with the foregoing processing steps. Through the processed color negatives-1 and -2, printing exposures were made to printing light-sensitive materials-1, -2 and -3 in the manner that color negative-1 is used to print printing light-sensitive materials-1 and -2, while color negative-2 is used to print printing light-sensitive material-3. The enlargement magnifications used in these printings were 5 times and 10 times. The exposed printing light-sensitive materials were subsequently processed in accordance with the foregoing processing steps to thereby obtain printed samples.

The image qualities of the resulting three printed samples were evaluated for the sharpness and graininess thereof and ranked as follows:

| | | | | | | |
|---|---|---|---|---|---|---|
| Enlargement magnification: 5 times | | | | | | |
| Sharpness: | | | | | | |
| (Better) | Printing light-sensitive material-3 (this invention) | ÷ | Printing light-sensitive material-2 (control) | > | Printing light-sensitive material-1 (control) | (worse) |
| Graininess: | | | | | | |
| (Better) | Printing light-sensitive material-3 (this invention) | ÷ | Printing light-sensitive material-1 (control) | > | Printing light-sensitive material-2 (control) | (worse) |
| Enlargement magnification: 10 times | | | | | | |
| Sharpness: | | | | | | |
| (Better) | Printing light-sensitive material-3 (this invention) | > | Printing light-sensitive material-2 (control) | > | Printing light-sensitive material-1 (control) | (worse) |
| Graininess: | | | | | | |
| (Better) | Printing light-sensitive material-3 (this invention) | >> | Printing light-sensitive material-1 (control) | > | Printing light-sensitive material-2 (control) | (worse) |

As apparent from the above results, printing light-sensitive material-2 having the combination of the color sensitivity of the conventional type emulsion with the coupler and processed in the activator solution shows the improvement in the sharpness, but the deterioration of the graininess, while the printing light-sensitive material of the present invention shows the satisfactory color image reproduction with much improved sharpness and with no deterioration of the graininess, which are noticeable when an increased magnification is applied to the enlargement in printing the image.

EXAMPLE 2

A color negative-3 and a color negative-4 were prepared in similar manners to those in Example 1 with the exception that the yellow couplers used for color negative-1 and color negative-2 were used together with the following yellow couplers Y-3 and Y-4 and the quantities of silver in the silver halide emulsions were changed as described below:

Y-3: α-[4-(1-benzyl-2-phenyl-3,5-dioxo-1,2,4-triazolidinyl)]-α-pivaloyl-2-chloro-5-[α-(dodecyl-oxycarbonyl)ethoxycarbonyl]acetanilide Y-4: α-benzoyl-2-chloro-5-[α-(dodecyl-oxycarbonyl)ethoxycarbonyl]acetanilide.

Color Negative-3

Layer-1 to layer 7, and layer 10: Identical with those same numbered layers of color negative-1 in Example 1.

Layer 8: A low-speed blue-sensitive emulsion layer containing 1.35 g of a blue-sensitive silver iodobromide emulsion (the same as the emulsion used in the layer 8 of color negative-1), 1.9 g of gelatin and 0.7 g of DBP into which were dissolved the following materials: 1.00 g of yellow coupler Y-3, 0.35 g of yellow coupler Y-4 and 0.025 g of DIR material D-2.

Layer 9: A high-speed blue-sensitive emulsion layer containing 1.65 g of a high-speed blue-sensitive silver iodidobromide emulsion (the same as the emulsion used in the layer 9 of color negative-1), 2.0 g of gelatin and 0.21 g of DBP into which were dissolved the following materials: 0.12 g of yellow coupler Y-3, 0.30 g of yellow coupler Y-4 and 0.008 g of DIR material D-2.

Layer 1 to layer 4, and layer 7 to layer 10: Identical with those same numbered layers of color negative-2 in Example 1.

Layer 5: A low-speed green-sensitive emulsion layer containing 1.45 g of a low-speed green-sensitive silver iodobromide emulsion (the same as the emulsion used in the layer 5 of color negative-2), 1.7 g of gelatin and 0.7 g of DBP into which were dissolved the following materials: 1.00 g of yellow coupler Y-3, 0.035 g of yellow coupler Y-4 and 0.025 g of DIR material D-2.

Layer 6: A high-speed green-sensitive emulsion layer containing 1.80 g of a high-speed green-sensitive silver iodobromide emulsion (the same as the emulsion used in the layer 6 of color negative-2 in Example 1), 1.9 g of gelatin and 0.21 g of DBP into which were dissolved the following materials: 0.12 g of yellow coupler Y-3, 0.30 g of yellow coupler Y-4 and 0.008 g of DIR material D-2.

The dyes formed from the yellow couplers used for color negatives-3 and -4 were measured for the absorption maximum wavelengths and molecular extinction coefficients thereof in the same manner as in Example 1, and then the results were obtained as shown in Table 3

TABLE 3

| Nondiffusible coupler | Absorption max wavelength | Molecular extinction coefficient |
|---|---|---|
| Y-3 | 448 nm | $1.3 \times 10^4$ |
| Y-4 | 455 nm | $1.1 \times 10^4$ |

Further, printing light-sensitive materials-4 and -5 were prepared in similar manners to those in Example 1 with the exception that the color developing agent precursor used in printing light-sensitive materials -2 and -3 was replaced by exemplified precursor-14, which was used in the same molar quantity as in Example 1.

The thus prepared color negatives-3 and -4 were used to photograph various subjects in a manner similar to that in Example 1 and then processed to form dye images, and after that, printings were made with 10-time enlarging magnification from color negative-3 to printing light-sensitive materials-1 and -4, and from color negative-4 to printing light-sensitive material-5.

Subsequently, as described earlier in Example 1, printing light-sensitive material-1 was processed in the normal color developing manner and printing light-sensitive materials-4 and -5 were processed in the alkaline activator bath, thereby obtaining final color images.

The resulting samples were evaluated for the sharpness and graininess thereof in similar manner to that in Example 1. The results are shown in Table 4.

TABLE 4

| | Graininess | Sharpness |
|---|---|---|
| Printing light-sensitive material-1 | 2 | 3 |
| Printing light-sensitive material-4 | 3 | 2 |
| Printing light-sensitive material-5 | 1 | 1 |

(The above numbers represent the evaluated rankings.)

Also in this example, it is apparent from the results that the color image reproduction method of the present invention using the combination of color negative-4 with printing light-sensitive material-5 enables to provide photographic prints having the highest image quality.

EXAMPLE 3

There were prepared printing light-sensitive materials-6, -7 and -8 the same as printing light-sensitive materials-1, -2 and -3 with the exception that the layer 1 and the layer 5 of each of light-sensitive materials-1, -2 and -3 in Example 1 were interchanged.

Printings were made with the 10-time enlarging magnification from the processed color negative-1 obtained in Example 1 to printing light-sensitive materials-6 and -7 and from the processed color negative-2 obtained in Example 1 to printing light-sensitive material-8. Subsequently, the exposed printing light-sensitive material-6 was processed in the normal color developing manner and the exposed printing light-sensitive materials-7 and -8 were processed in the alkaline activator bath as in Example 1, whereby color images were obtained.

The resulting color images were then evaluated for the sharpness and the graininess thereof, and consequently, similar results to those in Example 1 were obtained. Accordingly, the method for the color image reproduction in the present invention thus is understood to provide excellent quality color dye images having much improved graininess and sharpness as compared to those conventionally known color image reproduction methods.

What we claim is:

1. A method for the reproduction of a color image which comprises the formation of a dye image on a photographic light-sensitive material, said formation of a dye image being carried out in the manner that a photographic light-sensitive material for camera-exposure use is imagewisely exposed and processed to form a dye image, and through said photographic light-sensitive material having said image, an exposure is made on a photographic printing light-sensitive material and said exposed photographic printing light-sensitive material is then processed in an alkaline activator solution to thereby form a dye image thereon, said photographic light-sensitive material for camera-exposure use comprising a transparent support provided thereon with a red-sensitive silver halide emulsion layer, a green-sensitive silver halide emulsion layer and a blue-sensitive silver halide emulsion layer, said emulsion layers each comprising one of three different couplers selected from nondiffusible couplers capable of forming, by the coupling reaction with the oxidized product of a silver halide developing agent, compounds having spectral absorption maximum wavelength in the wavelength region longer than 340 nm, the spectral absorption maximum wavelength of said compounds being at least 30 nm spaced apart from one another, said blue-sensitive silver halide emulsion layer comprising a coupler capable of forming said compound having the highest molecular extinction coefficient among said three different couplers and said green-sensitive silver halide emulsion layer comprising a coupler capable of forming said compound having the lowest molecular extinction coefficient among said three different couplers, and said photographic printing light-sensitive material comprising a support provided thereon with three different light-sensitive silver halide emulsion layers having the respective spectral sensitivity thereof corresponding to the respective absorption maximum wavelength of said compounds formed in said photographic light-sensitive material for camera-exposure use, said silver halide emulsion layers each comprising one of three nondiffusible yellow, magenta, and cyan coupler, and containing a color developing agent and/or the precursor thereof.

2. A method according to claim 1, wherein the three different couplers in said photographic light-sensitive material for camera-exposure are a yellow, magenta and cyan coupler.

3. A method according to claim 1, wherein the coupler in said blue-sensitive silver halide emulsion layer is a magenta coupler or a cyan coupler.

4. A method according to claim 3, wherein the coupler is a magenta coupler.

5. A method according to claim 1, wherein the coupler in said green-sensitive silver halide emulsion layer is a yellow coupler.

6. A method according to claim 1, wherein the three different light-sensitive silver halide emulsion layers in said photographic printing light-sensitive material are a red-sensitive silver halide emulsion layer, a green-sensitive silver halide emulsion layer and a blue-sensitive silver halide emulsion layer.

7. The method of claim 1, wherein said photographic light-sensitive material for camera-exposure contains on the support thereof in order a nondiffusible α-naphthol cyan coupler-containing red-sensitive silver halide emulsion layer, a non-diffusible α-acylacetanilide yellow coupler-containing green-sensitive silver halide emulsion layer and a nondiffusible 1-phenyl-5-pyrazolone magenta coupler-containing blue-sensitive silver halide emulsion layer, and wherein said photographic printing light-sensitive material contains on the support thereof a nondiffusible phenol cyan coupler-containing red-sensitive silver halide emulsion layer, a nondiffusible α-pivaloylacetanilide yellow coupler-containing green-sensitive silver halide emulsion layer and a nondiffusible 1-phenyl-3-anilino-5-pyrazolone or pyrazolotriazole magenta coupler-containing blue-sensitive silver halide emulsion layer.

* * * * *